United States Patent [19]

Cohen

[11] Patent Number: 4,738,452

[45] Date of Patent: Apr. 19, 1988

[54] BOARD GAME INCLUDING A BOARD HAVING NUMEROUS SECTIONS

[76] Inventor: Barbara R. Cohen, 2882 Arlington Ave., Highland Park, Ill. 60035

[21] Appl. No.: 776,843

[22] Filed: Sep. 17, 1985

[51] Int. Cl.[4] ..... A63F 3/00

[52] U.S. Cl. ..... 273/248; 273/285; 273/287

[58] Field of Search ..... 273/248, 249, 243, 252, 273/285, 287

[56] References Cited

U.S. PATENT DOCUMENTS

| | | | |
|---|---|---|---|
| 506,797 | 10/1893 | Schaff et al. . | |
| 648,961 | 5/1900 | Hurd . | |
| 651,811 | 6/1900 | Sexton . | |
| 684,938 | 10/1901 | Knecht . | |
| 695,303 | 3/1902 | Graham . | |
| 1,208,992 | 12/1916 | Leonard . | |
| 1,209,373 | 12/1916 | Zarker . | |
| 1,536,672 | 5/1925 | Hobbs | 273/249 |
| 2,949,306 | 8/1960 | Gitelson et al. . | |
| 3,414,264 | 12/1968 | Schriber | 273/249 |
| 3,633,913 | 1/1972 | Solimene . | |
| 3,959,893 | 6/1976 | Sigg | 273/146 |
| 4,139,199 | 2/1979 | Drummond . | |
| 4,264,077 | 4/1981 | Horne | 273/249 |
| 4,272,080 | 6/1981 | Breslin | 273/249 |
| 4,515,369 | 5/1985 | Johnson | 273/248 |

*Primary Examiner*—Matthew L. Schneider

*Attorney, Agent, or Firm*—Fitch, Even, Tabin & Flannery

[57] ABSTRACT

A board game that can be played by two or more persons that it is not only amusing to play but which has more than on mode of play which can be utilized according to the desires and time constraints of the participants. The game includes a chance selection device and at least one game board. The game board includes a playing surface having at least one section wherein the section includes a start subsection, and a device for recording a subsection selection and at least three groups of a plurality of labeled subsections. The groups include a first group of subsections, a second group of subsections and a third group of subsections. The first and second groups are adjacent the start subsection while the third group is adjacent the first or second group. The recording device includes an apparatus for identifying and recording a selected subsection in the first group.

12 Claims, 1 Drawing Sheet

BOARD GAME INCLUDING A BOARD HAVING NUMEROUS SECTIONS

BACKGROUND OF THE INVENTION

This invention relates to a board game. More particularly this invention relates to a board game not only governed by chance, but where the chance is controlled, the length of the game may be controlled by the participants and the mode of play of the game may be varied according to the desires and time constraints of the participants.

SUMMARY OF THE INVENTION

An object of this invention is to provide a board game to be played by two or more persons which is not only amusing to play, but which has more than one mode of play and which can be utilized according to the desires and time constraints of the participants.

The novel features, other objects and advantages of the invention will become apparent from the following detailed description taken in connection with the accompanying drawings.

DETAILED DESCRIPTION OF THE INVENTION

Figure 1:
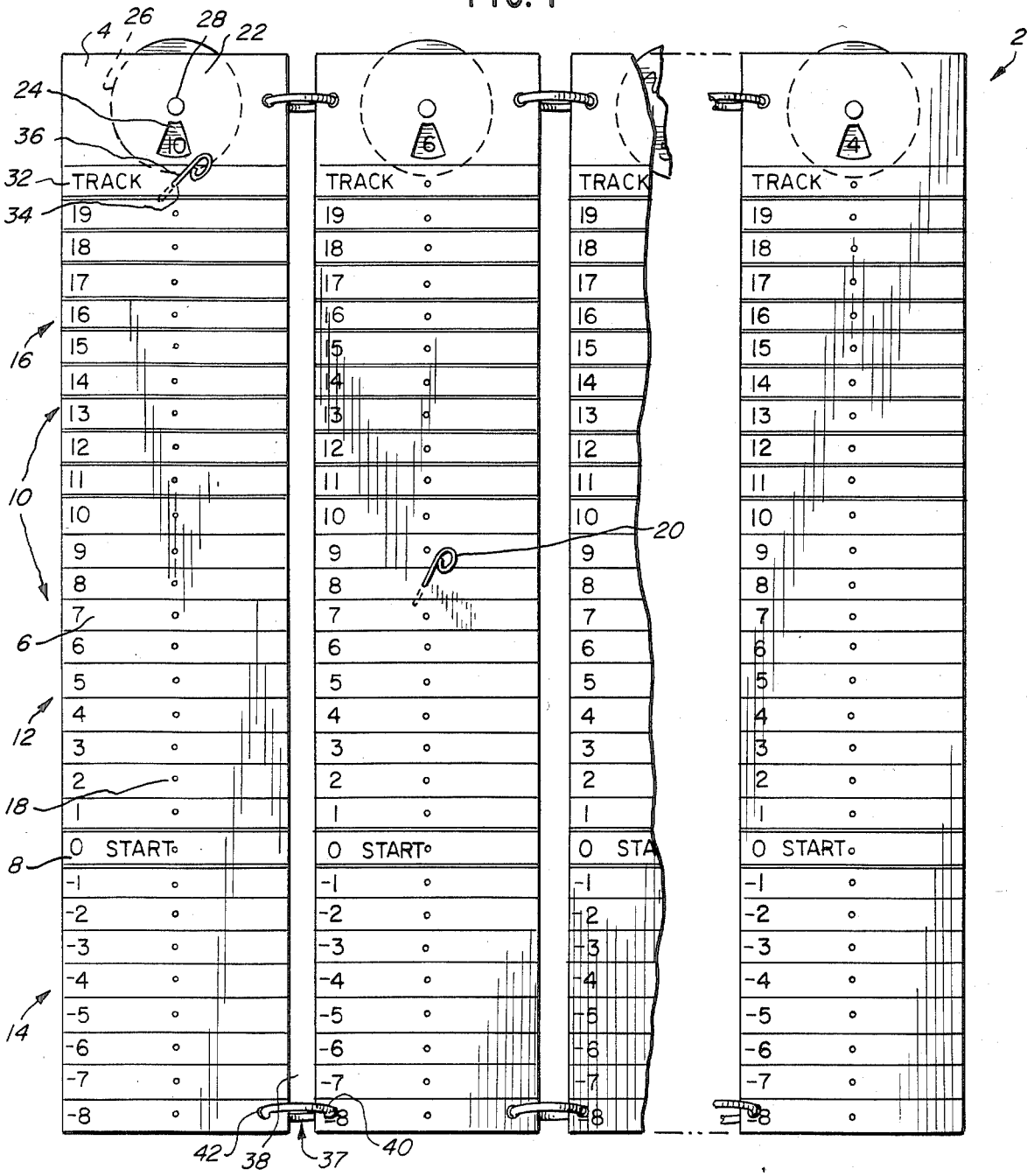
FIG. 1 is a top plan view of the game board of the invention.

In accordance with the present invention a game is provided, the game comprising:

at least one game board, the game board having a playing surface divided into at least one section, the section including a labeled start subsection, at least three groups of a plurality of other labeled subsections, the groups including a first group of subsections adjacent the start subsection, a second group of subsections adjacent the start subsection, and a third group of subsections adjacent the first or second group, and means for recording a subsection selection, the recording means including means for identifying and recording a selected subsection in the first group; means for chance selection, the chance selection means having provision for randomly selecting any one of the subsections in the first group of subsections, the total number of subsections in the first, second and third groups and the start subsection being at least twice as many subsection selections on the chance selection means, the selections of the chance selection means having indicia corresponding to and identifying a respective subsection of the first group; and at least one playing token for movement from the start subsection and among all of the subsections of the three groups of each section to the selected subsection in the first group of each section.

In a preferred embodiment of the invention, there are several game boards with each player having a board. The board is divided into 10 sections which are strips. Each strip has a start subsection and three groups of other subsections. The first group is adjacent the start subsection and has ten subsections labeled 1 to 10. The second group is adjacent the start subsection and has 8 subsections labeled −1 to −8. The third group is adjacent the first group and has 9 subsections labeled 11 to 19. Preferably, the number of subsections in the second and third groups should be three less than twice the number of subsections in the first group assuming the chance selection mechanism provides for the random selection of no more than the number of subsections in the first group excluding the selection of items by the chance selection mechanism which do not directly indicate subsections, e.g., "lose turn" or "win two turns". The means for identifying and recording the selected subsection includes a window or hole in the board and a rotatable disc divided into 10 sections numbered 1 to 10, the disc being below the board and rotated on a post or rivet to position a player selected number below the window or hole such that the number is seen through the board to identify and remind all players of the subsection in the first group of the section or strip selected to be reached as a selected goal by a player. The chance selection means is a twelve-sided die or a dodecahedron, ten sides of which are numbered 1 to 10, one side of which is labeled "lose turn" and one side of which is labeled "win two turns". The playing token is a peg which interfits into holes in the subsections of each section or strip. The number of subsections permitting, the peg is moved toward the preselected subsection and among the subsections of each strip upon the roll of the die. If the number of subsections does not permit movement toward the preselected subsection, the peg is moved in the opposite direction. In the preferred form of play the number of subsections in the second and third groups is three less than twice the number of subsections in the first group and movement of the peg is always toward the preselected subsection of the first group which is indicated as a goal on the identification means. In play there may be as many players as there are boards. Each player rolls the die and moves his peg toward his preselected subsection identified by number. The peg is moved forward (away from the player) or backward (toward the player) whichever takes the peg closer to the preselected subsection. After reaching the preselected subsection the player wins the game or goes onto another section as a part of the game which includes any number of strips or sections. Ten such sections are provided in the depicted embodiment. The invention is not, however, limited to a given number of sections.

Referring now to FIG. 1 of the drawings, a game board 2 is divided into ten strips 4 arranged in side by side relationship. Each strip is divided into a plurality of subsections 6 including a specific start or zero subsection 8. The remaining subsections are divided into three groups 10. There is a first group 12 above and adjacent the start subsection, the first group having ten subsections numbered 1 to 10. The second group 14 is adjacent and below the start subsection, and has eight subsections numbered −1 to −8. The third group 16 is adjacent and above the first group and has nine subsections numbered 11 to 19. Each subsection, including the start subsection, has a token hole 18 which is adapted to receive a peg 20. A subsection reference recorder 22 is at the top of each strip of subsections. The reference recorder includes an indicator such as a hole or window 24 in the board and a rotatable wheel 26 below the plane of the board on a pivot 28. The wheel is divided into ten sections which are numbered from 1 to 10. When a selected numbered section of the wheel is opposite and below the window, the number appears in the window and the reference recorder records and reminds the player of such number. Hence, the player using the strip of subsections during play of the game is reminded of the number of the preselected subsection in the first group of 10 subsections which are in the strip below the reference recorder. This will aid the player using the strip during play of the game as will the hereinafter described. Alternately, the rotatable wheel may be in ten pie shaped sections and the wheel may be rotated on the top surface of the board opposite an indicator such as a pointer outside the circumference of the rotable wheel. When the pointer is opposite a selected numbered pie shaped section, it reminds a player of the preselected subsection of the strip being played.

A reference subsection 32 lies below the reference recorder and above the third group 16 adjacent the subsection 19 of the third group such that it is between the third group and the reference recorder. Each reference subsection has a reference hole 34 adapted to receive a reference peg 36. The peg used in conjunction with the holes in the reference subsections serves as a mechanism to remind the player what strip he is playing. This is done by placing the peg in the hole of the reference section located in the strip being played.

Figure 2:
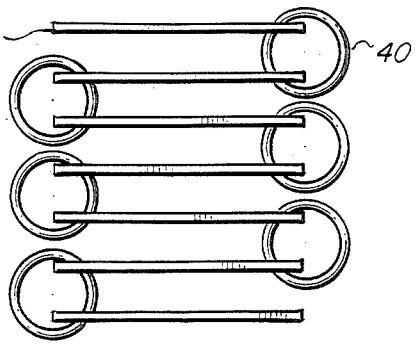
FIG. 2 is a side view of the folded game board.

The game board of the invention is made of cardboard, plastic or other suitable flat material. The board is foldable at hinges 37 along lines 38 such that the strips may be folded onto one another. As seen in FIG. 2, which is a side view of the game board in folded relation, the strips 4 are folded onto one another along lines 38. These lines may be thin portions of the game board or the strips may be attached or hinged together by means of a decorative string 40, twine or other lacing device which is looped through holes 42 at the top and bottom of each strip to hold each strip in side by side relation.

Figure 3:
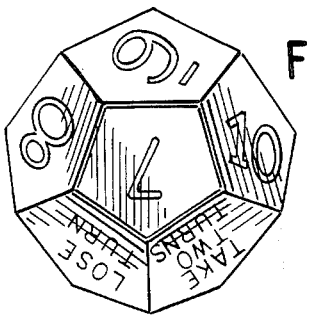
FIG. 3 is a perspective of a chance selection that may be used in connection with the invention.

The game includes a chance selection means which can take the form of one or more die, FIG. 3, or a wheel with a pointer and sections indicating how the peg will be moved among the subsections in the first, second and third groups of a strip being played. The chance selection mechanism should have at least as many selections of sections or designations as there are subsections in the first group of subsections in each strip. Hence, a player has the opportunity to achieve his selected subsection on his first play. With the player being entitled to a turn immediately after reaching his selected subsection, a player could theoretically reach each selected subsection in each strip in as many turns and win the game. In the preferred form of the game the chance selection mechanism is a twelve-sided die or a dodecahedron. Ten faces of the die are labeled with the numbers 1 to 10 which correspond to the ten subsections labeled 1 to 10 in the first group of each strip. The remaining two faces of the twelve-sided die are labeled "lose turn" and "take two extra turns". During play when one of the designations of "lose turn" or "take two extra turns" appears at the top of the die, as will be more fully described infra, the player may lose his turn or take two extra turns by rolling the die two more times. In the preferred form of the game a player would be entitled to another turn after reaching his selected subsection.

Game play proceeds clockwise. As many players as playing boards may play, however, a single playing board may be divided among the players by having the players select strips upon which they will play. More than one player may simultaneously play the same strip, each placing a token in the appropriate subsection. To start play a player will place his peg 20 into the token hole in the start section of the first strip of his board. To indicate and remind him he is playing on the first strip he will place his reference peg into the reference hole which lies in the reference subsection between the reference rocorder and the last subsection of the third group of each strip. The player will also preselect a subsection of the first group which will serve as his goal as to the subsection he desires to reach during his play in respect to that strip. In this connection the player may also preselect all of the subsections of the various strips he will have to play which subsections will be his goals. To indicate and remind players of the preselected subsection or subsections of the first group, or groups if all subsections are preselected the player will dial the number of such subsection on the reference recorder such that the number of the preselected subsection will appear on the wheel of the recorder opposite the arrow of the recorder. To determine which player will start play in respect to moving his peg, each player will take a turn rolling the die with the player having the highest number indicated on the die going first to start the game. When play starts, the player rolls the die and moves his peg in the direction of the subsection having the preselected reference number which number is also indicated on the reference recorder at the top of the strip of the subsections which is being played. The player rolls the die and moves his peg toward his preselected reference number by moving his reference peg up or down the subsections according to the number showing on the face of the die which faces upward. After ultimately reaching the subsection with the reference number that had been preselected in a strip, the reference peg is moved to the next strip, the playing peg is moved to the start subsection of the next strip and the player get another turn to continue play on the next strip of subsections. The player rolls the die and moves hig peg toward his preselected reference number by moving his reference peg up or down the subsections according to the number facing upward on the face of the die. When a player ultimately reaches the subsection with the reference number that he has preselected in a strip, he moves his reference peg to the next strip and he moves his playing peg to the start subsection of the next strip. Then the player continues to play on the next strip of subsections with his goal being another preselected subsection in the first group, that subsection having a number which ranges from one to ten. If a player rolls "take two extra turns", he may roll the die twice in seeking to reach his preselected subsection; or alternatively, if a player rolls "lose a turn," he loses a turn and an opportunity to reach his preselected reference numeral. By example, if the player chooses a subsection labeled with the reference numeral 3 in the first group of the first strip, he will set the reference rocorder such that the section of the reference recorder showing 3 is opposite the arrow outside the circumference of the wheel. If at his first turn the player rolls a 6, he will move his peg from the start position to the subsection in the first strip with the number 6. At his second turn, if the player rolls an 8, he will move toward his preselected subsection 3 and move his peg back towards that subsection to the subsection with the number −2 in the second group of subsections below and adjacent to the start subsection. If on his third turn, the player rolls a 5, he will move his peg back toward the subsection 3 and land on it. After reaching the subsection 3, the reference peg at the top of the strip will be moved to the top of the second strip and the player will resume his play seeking a second preselected subsection in the second strip with play continuing until the player has reached ten preselected subsections on all ten strips of his board. The winning player is the player who reaches his selected subsections first. According to the time constraints of the players the game can be played in alternate form by selecting less than ten strips which are to be played by the players. Moreover, more than one player may play one board with each player playing a strip on the board.

It should be understood while certain preferred embodiments of the present invention have been illustrated and described, various modifications of the invention will become apparent to those skilled in the art. Accordingly, the scope of the present invention should be defined only by the appended claims and equivalents thereof.

Various features of the invention are set forth in the following claims.

What is claimed is:

1. A game comprising means for chance selection having a plurality of subsections;

at least one playing token; and at least one game board, the game board having a playing surface having at least one section, the section including a start subsection having indicia associated therewith designating it as the starting location for playing pieces, a first group of a plurality of labeled subsections, means for recording a subsection selection, the recording means including means for identifying and recording a selected subsection in said first group, said chance selection means including the same number of subsections as there are subsections in the first group for randomly selecting any one of the subsections in said first group of subsections, the subsections of said chance selection means having indicia corresponding to and identifying the respective subsections of said first group;

a second group of a plurality of subsections adjacent the start subsection;

and a third group of a plurality of subsections adjacent the first or second group, the total number of subsections in the first, second and third groups and the start subsection being at least twice the number of subsection selections in the chance selection means, the playing token being for movement from the start subsection and among all the subsections of the three groups of each said section to the selected subsection in said first group of each section, the at least one section being in the form of a longitudinal strip of adjacent subsections including the start subsection and the third group being adjacent the first group, the first, second and third groups being in linear relation, and the start subsection being between the first group and the second group.

2. A game as recited in claim 1 wherein the number of subsections in the second and third groups is three less than twice the number of subsections in the first group.

3. A game as recited in claim 2 wherein the means for chance selection is a twelve-sided die, the twelve sides constituting said plurality of subsections, with one die side indicating win two turns and with one die side indicating lose a turn.

4. A game as recited in claim 2 wherein there are at least two sections.

5. A game as recited in claim 2 wherein the first group includes ten subsections, the second group includes eight subsections and the third group includes nine subsections.

6. A game as recited in claim 5 wherein there are at least two sections.

7. A game as recited in claim 1 wherein te means for chance selection is a twelve-sided die, the twelve sides constituting said plurality of subsections, with one die side indicating win two turns and with one die side indicating lose a turn.

8. A game comprising means for chance selection having a plurality of subsections;

at least one playing token; and at least one game board, the game board having a playing surface having at least one section, the section including a labeled start subsection, a first group of a plurality of labeled subsections, means for recording a subsection selection, the recording means including means for identifying and recording a selected subsection in said first group, said chance selection means including the same number of subsections as there are subsections in the first group for randomly selecting any one of the subsections in said first group of subsections, the subsections of said chance selection means having indicia corresponding to and identifying respective subsections of said first group;

a second group of a plurality of subsections adjacent the start subsection;

and a third group of a plurality of subsections adjacent the first or second group, the total number of subsections in the first, second and third groups and the start subsection being at least twice the number of subsection selections in the chance selection means, the playing token being for movement from the start subsection and among all the subsections of the three groups of each said section to the selected subsection in said first group of each section, the recording means including a rotatable wheel and an indicator in respect to the wheel, the wheel having subsections equal in number to those in the first group which are correspondingly labeled to the subsections of the first group to identify and record a selected subsection in the first group when a respective subsection of the wheel is rotated and located relative to the indicator.

9. A game as recited in claim 8 wherein the first group includes ten subsections, the second group includes eight subsections and the third group includes nine subsections.

10. A game comprising means for chance selection having a plurality of subsections;

at least one playing token; and at least one game board, the game board having a playing surface having at least one section, the section including a labeled start subsection, a first group of a plurality of labeled subsections, means for recording a subsection selection, the recording means including means for identifying and recording a selected subsection in said first group, said chance selection means including the same number of subsections as there are subsections in the first group for randomly selecting any one of the subsections in said first group of subsections, the subsections of said chance selection means having indicia corresponding to and identifying respective subsections of said first group;

a second group of a plurality of subsections adjacent the start subsection;

and a third group of a plurality of subsections adjacent the first or second group, the total number of subsections in the first, second and third groups and the start subsection being at least twice the number of subsection selections in the chance selection means, the playing token being for movement from the start subsection and among all the subsections of the three groups of each said section to the selected subsection in said first group of each section, the first group having ten subsections, each subsection of the first group being consecutively labeled with a digit ranging from 1 to 10 starting with the digit 1 adjacent the start subsection, the second group having eight subsections, each subsection of the second group being consecutively labeled with a digit ranging from −1 to −8 with the digit −1 adjacent the start subsection, and the third group having nine subsection, each subsection of the third group being consecutively labeled with a digit ranging from 11 to 19 with the digit 11 being adjacent the subsection labeled 10 in the first group.

11. A game as recited in claim 10 wherein there are ten sections.

12. A game as recited in claim 11 wherein the means for chance selection is a twelve-sided die, the twelve sides constituting said plurality of subsections, and wherein ten of the sides of the die are labeled to indicate the numbers one to ten, each of the ten sides having a label to indicate a separate number, one side of the die labeled to indicate lose a turn, and one side of the die labeled to indicate take two extra turns.

* * * * *

UNITED STATES PATENT AND TRADEMARK OFFICE

CERTIFICATE OF CORRECTION

PATENT NO. : 4,738,452

DATED : April 19, 1988

INVENTOR(S) : Barbara R. Cohen

It is certified that error appears in the above-identified patent and that said Letters Patent is hereby corrected as shown below:

On the Title Page,

In the Abstract, line 3, change "on" to --one--.

Column 4, line 4, change "rocorder" to --recorder--.

Column 4, line 25, change "subsections" to --subsection--.

Column 4, line 34, change "get" to --gets--.

Column 4, line 36, change "hig" to --his--.

Column 6, line 7, change "te" to --the--.

Column 8, line 5, change "subsection" to --subsections--.

Signed and Sealed this

Twenty-seventh Day of June, 1989

*Attest:*

DONALD J. QUIGG

*Attesting Officer*

*Commissioner of Patents and Trademarks*